US012256858B2

(12) United States Patent
Mainetti

(10) Patent No.: US 12,256,858 B2
(45) Date of Patent: Mar. 25, 2025

(54) CLIP FOR HANGERS

(71) Applicant: MAINETTI S.P.A, Castelgomberto (IT)

(72) Inventor: Mario Mainetti, Valdagno Vicenza (IT)

(73) Assignee: MAINETTI S.P.A., Vicenza (IT)

( * ) Notice: Subject to any disclaimer, the term of this patent is extended or adjusted under 35 U.S.C. 154(b) by 0 days.

(21) Appl. No.: 18/555,800

(22) PCT Filed: Apr. 21, 2022

(86) PCT No.: PCT/EP2022/060632
§ 371 (c)(1),
(2) Date: Oct. 17, 2023

(87) PCT Pub. No.: WO2022/223740
PCT Pub. Date: Oct. 27, 2022

(65) Prior Publication Data

US 2024/0206657 A1 Jun. 27, 2024

(30) Foreign Application Priority Data

Apr. 23, 2021 (IT) ..... 102021000010376

(51) Int. Cl.
*A47G 25/48* (2006.01)

(52) U.S. Cl.
CPC ..... *A47G 25/485* (2013.01)

(58) Field of Classification Search
CPC .... A47G 25/48; A47G 25/483; A47G 25/485; A47G 25/50
See application file for complete search history.

(56) References Cited

U.S. PATENT DOCUMENTS 2,583,784 A * 1/1952 Maccaferri ..... D06F 55/02 223/91
2,666,240 A * 1/1954 Maccaferri ..... A47G 25/485 24/457
4,261,121 A * 4/1981 Coon ..... D06F 55/02 40/658

(Continued)

FOREIGN PATENT DOCUMENTS

EP 1421883 A1 * 5/2004 ..... A47G 25/485
JP 2000051051 2/2000
JP 3209945 U * 4/2017

*Primary Examiner* — Shaun R Hurley
(74) *Attorney, Agent, or Firm* — DUANE MORRIS LLP; Gregory M. Lefkowitz; Joaquin Hernandez

(57) ABSTRACT

The present disclosure relates to a clip for hangers applied to a bar having a pair of opposed blades reciprocally connected by means of an elastic element with opposed sides and curved nails being insertable into a recess present in each of the blades. The elastic element pushes the lower end of the blades into reciprocal contact. The elastic element "U"-shaped and each of the blades is composed of a first internal element and second external element superimposable on the first internal element to constitute said blade. Each of the second external elements has identical shapes and dimensions to the internal elements and are superimposable on each of the internal elements. The elastic element presents its opposite sides with at least one section that overlaps a portion of the internal elements before the curved nail is inserted in the recess.

9 Claims, 3 Drawing Sheets

(56) References Cited

U.S. PATENT DOCUMENTS

| | | | | |
|---|---|---|---|---|
| 5,241,728 | A | 9/1993 | Hunter | |
| 5,402,558 | A * | 4/1995 | Santapa | A47G 25/485 24/511 |
| 7,150,381 | B2 | 12/2006 | Goldman | |
| 2004/0099700 | A1 | 5/2004 | Misumi | |
| 2006/0042050 | A1* | 3/2006 | Misumi | D06F 55/02 24/3.1 |
| 2008/0201909 | A1* | 8/2008 | Misumi | A47G 25/483 24/3.1 |

* cited by examiner

CLIP FOR HANGERS

CROSS-REFERENCE TO RELATED APPLICATIONS

This application is a § 371 national stage entry of International Application No. PCT/EP2022/060632, filed Apr. 21, 2022, which claims priority to Italian Application No. 102021000010376, filed Apr. 23, 2021, the entire contents of which are incorporated herein by reference.

The invention concerns a clip for hangers for clothing garments. The invention also concerns a hanger using said clip.

It is well known that hangers for garments such as skirts and trousers are generally shaped to have a bar at the entire longitudinal length of these hangers. Clips can be fixed to the aforesaid ones, which have a pair of opposed blades, which are reciprocally connected by means of an elastic element with opposed sides, which sometimes takes on a U-shaped form.

In particular, it is provided that this elastic element can be placed astride above the bar of the hanger. In addition, each of the sides of the elastic element is insertable into a special hole present in each of the blades and acts in such a way as to push the lower end of the aforesaid ones into reciprocal contact.

It is also known that in most cases the clips, particularly for skirts and trousers, are made of plastic by automatic moulding processes. On the one hand, this makes it possible to obtain such hangers quickly and economically, which can be produced in large numbers in a very short time.

On the other hand, there is an increasingly widespread market demand for biodegradable and compostable products and/or in any case products that can be easily recyclable not only at an industrial level but also at home.

In addition, in particular, more and more processes and machinings are increasingly spreading that can allow the hangers to be made starting from cellulose pulp or paper material in general, which are easily recyclable and can be declared biodegradable and compostable, according to the strict rules governing these types of products. It goes without saying that these hangers, as well as their components and, in particular, any clips that may be present in them, must in any case be sufficiently rigid and robust to be able to effectively perform their use.

However, the current configuration of the blades currently on the market and made of plastic material is not suitable for the use of a biodegradable and compostable material such as cellulose pulp; in fact, they would be too fragile and elastic if made with these types of material.

As the most important document of the state of the art, reference is made to the Japanese publication JP2000051051 A which illustrates, in particular in its FIGS. 2 and 3 (the following references relate to this document), a clips for hangers, applicable to hangers for garments such as skirts and trousers, said hangers having a bar present along the entire longitudinal length of said hangers to which a pair of clips can be fixed, each of said clips having a pair of opposed blades (6), reciprocally connected by means of an elastic element (7) with opposed sides (13) (FIG. 2), a curved nail (13) being provided with concavity facing outwards at both ends of said elastic element, which can be placed astride above said bar of the clip; each of the sides of the elastic element being insertable into a recess present in each of the blades (FIGS. 2, 3), said elastic element acting in such a way as to push the lower end (8) of the blades into reciprocal contact, wherein each of the blades is composed of a first internal element (elastic cushion of sponge type 10) and of a second external element (the rest of the arm 6) superimposable on the first one and constituting a single body with said first internal element (FIGS. 2, 3).

Another important document is constituted by the publication US 2004/099700 A1 which, in particular, illustrates, in its FIGS. 1 and 5 (the following references relate to this document), a clip for hangers, applicable to hangers for garments such as skirts and trousers, said hangers having a bar present along the entire longitudinal length of said hangers to which a pair of clips can be fixed, each of said clips having a pair of opposed blades (FIG. 5), reciprocally connected by means of an elastic element (6) with opposed sides, substantially shaped like a "U", at both ends of said elastic element, which can be placed astride above said bar of the clip; each of the sides of the elastic element being insertable into a recess present in each of the blades, said elastic element acting in such a way as to push the lower end of the blades into reciprocal contact, wherein each of the blades is composed of a first internal element (14) and of a second external element superimposable on the first one and constituting a single body with said first internal element (FIGS. 4, 5).

The documents U.S. Pat. No. 7,150,381 B2 and U.S. Pat. No. 5,241,728 A are also mentioned.

However, with these types of configuration it is not possible to create clips for hangers built starting from sheets of pressed cardboard which, by their nature, are flat in shape. As can be seen from the documents mentioned above, the elements forming said clips are provided with reinforcement ribs, windows for the passage of the elastic element, as well as for its seat, and also with ergonomic areas on which to exert the force for opening the blades by means of the fingers.

Main object of the present invention is to realise an innovative clip for hangers, applicable to hangers for garments such as skirts and trousers, which, thanks to its configuration, is particularly suitable to be made of biodegradable and compostable recyclable material such as cellulose or paper material in general.

This is achieved, according to the invention, by providing, in particular, that each of the blades is composed of a first internal element and of a second external element, both of which have a flat surface; it is provided that the second external element is superimposable on the first one and constitutes a single body with said first internal element. Furthermore, it is provided that the first internal elements and the corresponding second external elements are identical between them.

Furthermore, it is provided that each of the second external elements has an identical perimeter development with respect to each of the first internal elements, each of the aforesaid external elements being therefore perfectly superimposable with respect to the corresponding first internal element substantially at the respective perimeter edges.

In particular, it is provided that the elastic element, which can be placed astride above the bar present in the hanger, clings to and is inserted in a special way with said blades, which, for this purpose, have special recesses, notches and windows to allow the arrangement of said elastic element, as well as to ensure that it is able to effectively exercise its function.

The invention also proposes to realise a hanger using one or two clips realised according to the above characteristics.

This and Other Features of the Invention Will Now be Described in Detail Hereinafter with Reference to Two Particular Embodiments Thereof, Given Solely by Way of Non-Limiting Example, with the Aid of the Attached Drawings, in which:

FIGS. 1 to 10 refer to a clip for hangers applicable to hangers for skirts and trousers according to the invention, wherein the hanger has a longitudinal bar with cylindrical shape;

in particular, FIGS. 1, 2 and 3 show, respectively, a frontal, lateral and perspective view of the second external element of each of the blades of the clip;

Figure 1:
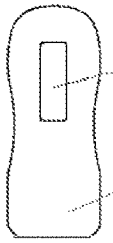
Figure 2:
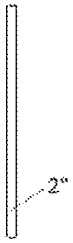
Figure 3:
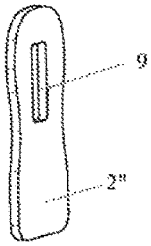
Figure 4:
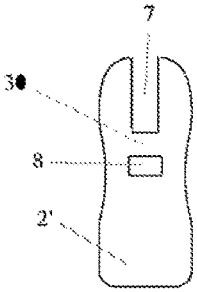
FIGS. 4, 5 and 6 show, respectively, a frontal, side and perspective view of an internal element present in each of the blades of the clip.
Figure 5:
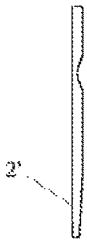

FIGS. 1 to 3, as well as 4 to 6, illustrate, respectively, the elements 2" and 2' which, once glued, fixed or in any case constituting a single body, constitute one of the blades 2 which, together with the opposed identical blades 3, constitutes the clip according to the invention. In particular, the first internal element 2' has an upper notch 7 shaped like a "U", below which there is a recess 8 at the surface 30 thereof facing outwards. This recess, which may consist of a through hole, or a blind recess, must be shaped to accommodate the end part of the elastic element that will be described later.

In particular, the first internal element 2' has an upper notch 7 shaped like a "U", below which there is a recess 8 at the surface thereof facing outwards. This recess, which may consist of a through hole, or a blind recess, must be shaped to accommodate the end part of the elastic element that will be described later.

Figure 7:
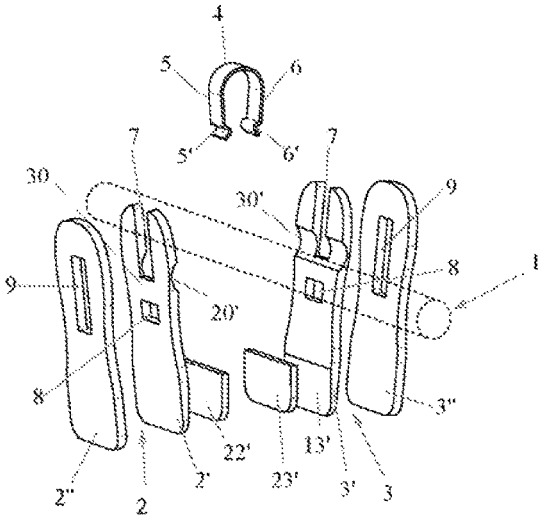
FIG. 7 shows an overall exploded view of said clip.
Figure 8:
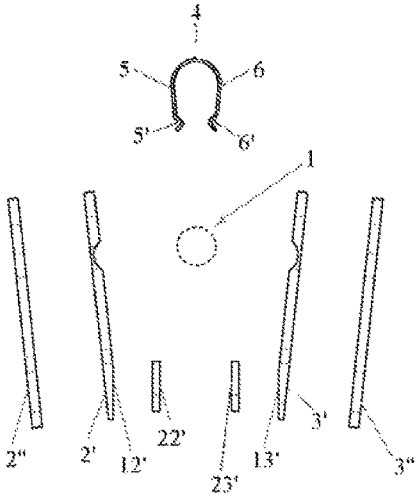
FIG. 8 shows an exploded side view of said clip.

On the other hand, the second external element 2" is superimposable on the first one, as can be seen in particular in FIGS. 7 and 8, and has an elongated window 9. This second external element 2" has the function of reinforcing the first internal element 2'. Advantageously, the second external elements 2", 3" have identical shapes and dimensions to the first internal elements 2', 3'. In this case, said second external elements 2", 3" are perfectly superimposable on said first internal elements 2', 3'.

As can be seen particularly in FIGS. 7 to 10, this clip is adapted to be used for hangers that have a longitudinal bar 1 of substantially cylindrical shape.

Figure 9:
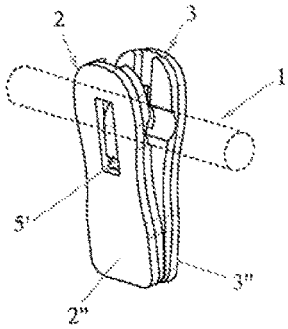
FIGS. 9 and 10 show, respectively, an overall perspective view and a vertical section view of said clip.

For this purpose, as can be seen in particular in FIGS. 7, 8 and 9, at the surface facing inwards of the first internal elements 2', 3', there are concavities 20', 30' in which portions of the external surface of the bar 1 are adapted to be inserted.

As already mentioned above, it will be ensured that the pairs of elements, respectively internal and external, 2' and 2", as well as 3' and 3", which together constitute a blade 2, 3 of the clip, are reciprocally connected so as to form a single structure. Advantageously, this will be achieved by first creating the individual elements, respectively internal and external, 2', 2", as well as 3', 3" and then gluing them to each other, even if it cannot be excluded that these elements are fixed to each other by means of crimping means, or with fixed or movable connections, etc.

In order to enable the reciprocal connection of the two blades 2, 3, as well as to connect both of them to the bar 1 and also to enable the clip to function elastically so that it is able to perform its function, there is provided an elastic element 4, substantially in the form of a "U", which can be placed astride above the bar 1 of the clip. A curved nail 5', 6' with concavity facing outwards is provided at the ends of both opposed sides 5, 6 of the elastic element 4. In particular, each of the sides 5, 6 of said elastic element 4 is inserted into a recess 8 present on the external surface of both first internal elements 2', 3'. In particular, it is provided that the elastic element 4 passes through the notch 7 of the first internal element 2', 3' and through the window 9 of the second external elements 2", 3".

Figure 10:
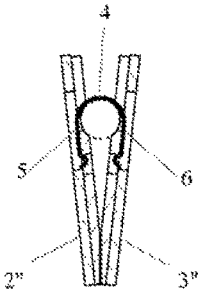
Figure 11:
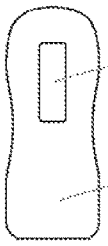
FIGS. 11 to 20 show views of the clip for hangers referred to in the invention, applicable to hangers for skirts and trousers in which the longitudinal bar has a different conformation from the cylindrical one, said figures showing exactly the same elements in the same positions with respect to FIGS. 1 to 10 in which the longitudinal bar is of the cylindrical type.
Figure 12:
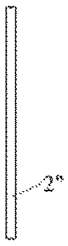
Figure 13:
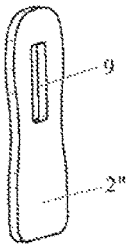
Figure 14:
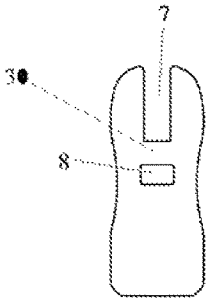
Figure 15:
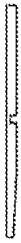
Figure 16:
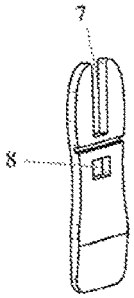

In practice, once the elastic element 4 has been correctly positioned, the clip structure shown in FIGS. 9, 10 will be obtained, with the upper portion of the two blades 2, 3 spread apart due to the presence of the bar 1, while the lower portion of the aforesaid ones is placed in reciprocal contact. This union is due precisely to the presence of the elastic element 4, which pushes the two blades 2, 3 against each other in the position illustrated in said FIGS. 9, 10. In this position any garment or the like can be held in position thanks to the reciprocal adhesion of the lower portions of the two blades 2, 3. This adhesion can be overcome simply by manually acting at the upper portions of the clip, on both of the two blades 2, 3 (at their portions placed higher than the bar 1), thus releasing the garment present inside the lower portion of the blades 2, 3.

Figure 6:
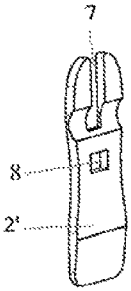

As can be seen in particular in FIGS. 6, 7 and 8, the lower portion of the internal surfaces of the first internal elements 2', 3' of the blades 2, 3 will advantageously present a chamfer 12', 13' on which it is possible to fix an insert 22' and 23' of sufficiently soft material, which is able to reduce the possibility of forming creases and the like on the garments placed between the two blades 2, 3, as well as to guarantee a greater coefficient of friction between the aforesaid elements, in order to facilitate the holding of the garments themselves in position, in particular when they are in a hanging position.

Conversely, FIGS. 11 to 20 illustrate the various elements constituting the clip referred to in the invention, as well as the aforesaid clip in its complexity, in another embodiment. In particular, this clip can be applied to a garment hanger in which the bar has a different shape, even though it is structurally similar and functionally identical to the cylindrical one illustrated above, and in fact it is identified in this case with reference 1'. In practice, the individual figures show the same entities illustrated in the previous figures and discussed above.

Figure 17:
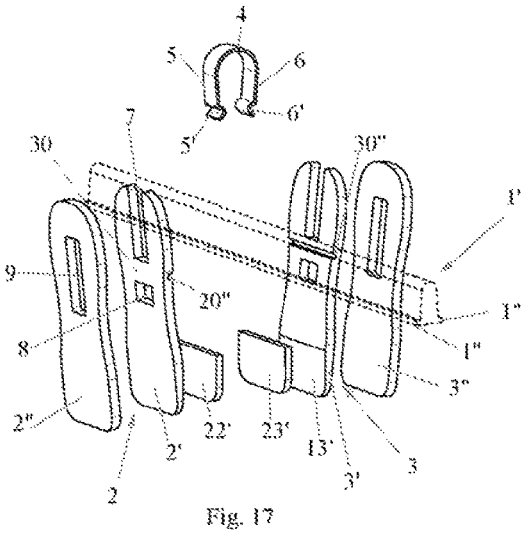
Figure 18:
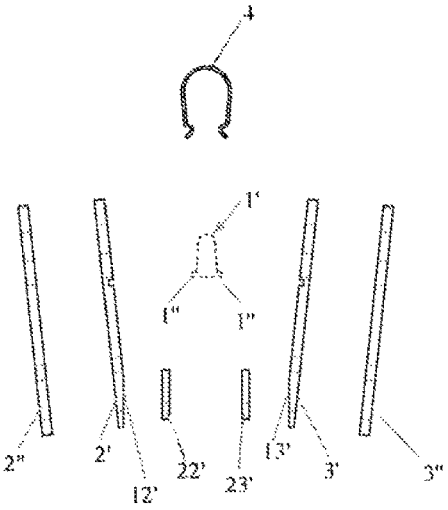
Figure 19:
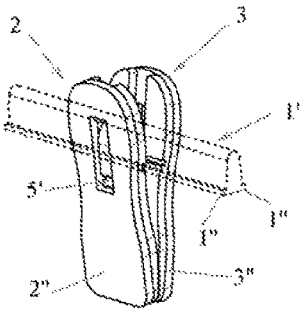
Figure 20:
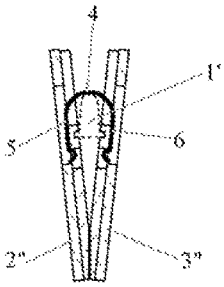
Figure 21:
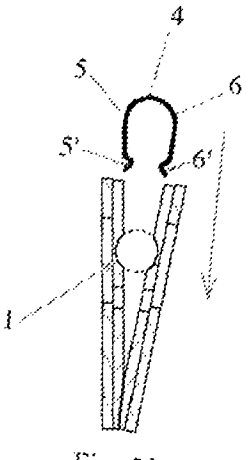
FIGS. 21 to 25 show, in succession, the various steps of inserting the elastic element present in each of them, astride the bar on which said clip is inserted.
Figure 22:
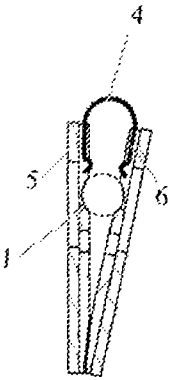
Figure 23:
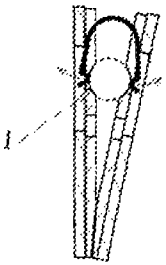
Figure 24:
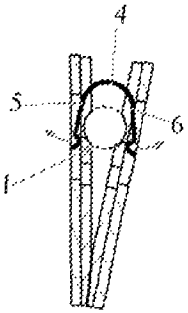
Figure 25:
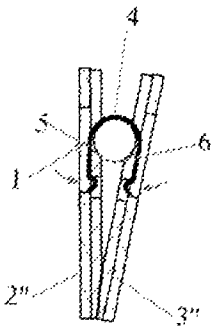

FIGS. 17 to 19 show that in this case the bar 1' has a conformation with lateral fins 1"; in this case it is in particular provided that at the surface of the first internal elements 2', 3' which is facing inwards and therefore practically towards the bar 1', there are concavities 30" constituted by simple grooves in which the fins 1" belonging to the bar 1' are housed and pivoted.

The various components of the elements, respectively internal and external, 2' and 2", as well as 3' and 3", as well as their positioning with respect to the elastic element 4 and still the overall operation of the clip are identical to those illustrated and described above.

From an operational point of view, the clip referred to in the invention, irrespective of the type of bar to which it is applied, is intrinsically suited to being made of recyclable material, mainly of material that is pulp-based or of paper type in general. This is mainly due to the fact that it is easy to make the various elements, respectively internal and external, 2' and 2", as well as 3' and 3" of the clips 2, 3 separately, which can be made from these materials. Starting from sheets of paper material, which by their nature are flat, the elements, respectively internal and external, 2' and 2" and 3' and 3" can be obtained by shearing, die-cutting or laser cutting operations and/or by other systems. The particular design of the first internal elements 2' and 3', which both have an upper notch 7, allows the elastic element 4 to be inserted into its seat as shown in FIGS. 21 to 25.

Still referring to FIGS. 21 to 25, the elastic element 4 is inserted without interference with the parts of the first internal elements 2' and 3' until the internal part of the curved nails 5' and 6' touch the bar 1.

By forcing the introduction of the elastic element, the sides 5 and 6 of the elastic element 4 open, allowing it to run until the curved nails 5' and 6' are stably positioned in the recesses 8 of the first internal elements 2' and 3'.

The second external elements 2" and 3" serve as reinforcement means of the first internal elements 2' and 3' and also cover the projection of the spring, the overall dimensions of which remain inside the external surface of the second external elements 2" and 3".

In practice, if the blades are made substantially starting from sheets of pressed cardboard, it is clear that it is impossible to create reinforcement ribs that are normally present in the corresponding blades produced by injection of a plastic material, just as it is practically impossible to create an ergonomic surface above the fulcrum where the fingers can be pressed to open the clip. Therefore, the second external elements 2", 3" have the function of stiffening and reinforcing the body of the blade that they constitute with the aid of the first internal elements 2', 3'. The second external elements 2", 3" also function as covering elements for the elastic element 4 and more precisely for the sides 5, 6 and the nails 5', 6'.

Again, the presence of the second external elements 2", 3" causes the elastic element 4 to remain positioned inside the window 9, remaining recessed and not protruding from the body of the blade, so as not to ruin the garments hung on the hanger.

In practice, should the clip unfortunately break or in any case it is desired to throw it away, it will be sufficient to tear it off so as to separate it from the elastic element 4, generally made of metallic material, in order to be able to throw it into the bins for the sorted collection of paper.

Among other things, the bars 1, 1' can also be easily made of cellulose- or paper-based material, also making them easily recyclable.

However, the clips referred to in the invention can naturally be made of different materials, for example plastic material, wood, metallic material, etc.

It should be noted that the present invention may take on aspects other than those previously illustrated and described, without prejudice to its essential characteristics provided they are defined in the following claims, without departing from the scope of the patent.

The invention claimed is:

1. CLIP FOR HANGERS, to be applied to a bar (1, 1') present along the entire longitudinal length of a hanger for clothing garments, said clip having a pair of opposed blades (2, 3), reciprocally connected by means of an elastic element (4) with opposed sides (5, 6), a curved nail (5', 6') being provided with concavity facing outwards, at both ends of said elastic element (4), which can be placed astride above said bar (1, 1') of the hanger; each of the curved nails (5', 6') of the elastic element (4) being insertable into a recess (8) present in each of the blades (2, 3), said elastic element acting in such a way as to push the lower end of the blades (2, 3) into reciprocal contact, wherein:

the elastic element is substantially "U"-shaped and each of the blades (2, 3) is composed of a first internal element (2', 3'), with a plane shape, and of a second external element (2", 3"), also with a plane shape, superimposable on the first one to constitute said blade (2, 3), being even provided that the first internal element (2', 3') are identical to each other, as are the corresponding second external elements (2", 3"), being also provided that each of the second external elements (2", 3") has a substantially identical perimeter development with respect to that of the first internal elements (2', 3'), each of the second external elements (2", 3") being therefore perfectly superimposable with respect to each of the first internal elements (2', 3'), due to the substantial coincidence of their perimeter edge, being finally provided that the elastic element, placed astride above the bar (1, 1'), presents its opposite sides (5, 6) with at least one section that overlaps a portion (30) of the first internal elements (2', 3'), before the curved nail (5', 6') is inserted in the recess; and the first internal elements (2', 3') have a "U"-shaped upper notch, while the second external elements (2", 3") have a window of elongated shape, into which portions of the elastic element are insertable.

2. CLIP FOR HANGERS, according to claim 1, wherein below the notch of the first internal elements (2', 3') there is the recess, at its outwardly facing surface.

3. CLIP FOR HANGERS, according to claim 2, wherein the portion (30) of the first internal elements (2', 3'), on which at least a portion of the opposite sides (5, 6) of the elastic element is superimposed, is placed between the notch and the recess.

4. CLIP FOR HANGERS, according to claim 3, wherein the elastic element has, at the ends of its sides (5, 6), curved nails (5', 6') insertable into the recesses present on the external surface of the first internal elements (2', 3'), passing through the notch of the first internal element (2', 3') and through the window of the second external element (2", 3").

5. CLIP FOR HANGERS, according to claim 1, wherein both first internal elements (2', 3') have, at their surfaces facing the bar (1), at least a concavity (20', 30') or (20", 30") of a shape corresponding to that of the portion of the bar opposed thereto, in which said portion of said bar can be housed to allow its stable positioning with respect to the clip and to act therefore as a fulcrum of the pair of clips (2, 3) with respect to the bar (1).

6. CLIP FOR HANGERS, according to claim 1, wherein the lower portion of the internal surfaces of the first internal elements (2', 3') of the blades (2, 3) has a chamfer (12', 13') on which an insert (22', 23') made of soft material or with non-slip characteristics is fixable.

7. CLIP FOR HANGERS, according to claim 1, wherein the first internal elements (2', 3') and the second external elements (2", 3") are fixable by gluing operations or by fixing with other means.

8. HANGER, comprising at least one of the clips according to claim 1.

9. HANGER, comprising two clips according to claim 1.

* * * * *